US011299798B2

(12) United States Patent
Takeuchi et al.

(10) Patent No.: US 11,299,798 B2
(45) **Date of Patent: *Apr. 12, 2022**

(54) STEEL PLATE AND METHOD OF PRODUCING SAME

(71) Applicant: JFE STEEL CORPORATION, Tokyo (JP)

(72) Inventors: Yoshiko Takeuchi, Tokyo (JP); Katsuyuki Ichimiya, Tokyo (JP); Kazukuni Hase, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 97 days.

This patent is subject to a terminal disclaimer.

(21) Appl. No.: 16/612,400

(22) PCT Filed: May 21, 2018

(86) PCT No.: PCT/JP2018/019553

§ 371 (c)(1),
(2) Date: Nov. 11, 2019

(87) PCT Pub. No.: WO2018/216665

PCT Pub. Date: Nov. 29, 2018

(65) Prior Publication Data

US 2020/0115782 A1 Apr. 16, 2020

(30) Foreign Application Priority Data

May 22, 2017 (JP) ..... JP2017-100635

(51) Int. Cl.

| | |
|---|---|
| ***C22C 38/04*** | (2006.01) |
| ***C21D 8/02*** | (2006.01) |
| ***C21D 9/00*** | (2006.01) |
| ***C22C 38/02*** | (2006.01) |
| ***C22C 38/06*** | (2006.01) |
| ***C22C 38/08*** | (2006.01) |
| ***C22C 38/20*** | (2006.01) |

(52) U.S. Cl.

CPC ..... *C22C 38/04* (2013.01); *C21D 8/0226* (2013.01); *C21D 8/0236* (2013.01); *C21D 9/00* (2013.01); *C22C 38/02* (2013.01); *C22C 38/06* (2013.01); *C22C 38/08* (2013.01); *C22C 38/20* (2013.01)

(58) Field of Classification Search

CPC ..... C21D 8/02; C21D 8/0226; C21D 8/0236; C21D 9/00; C22C 38/00

USPC ..... 420/119

See application file for complete search history.

(56) References Cited

U.S. PATENT DOCUMENTS

| | | | | |
|---|---|---|---|---|
| 8,668,784 | B2 | 3/2014 | Watanabe et al. | |
| 9,403,242 | B2 | 8/2016 | Fukunaga et al. | |
| 9,790,579 | B2 | 10/2017 | Yuga et al. | |
| 10,023,946 | B2 | 7/2018 | Terazawa et al. | |
| 10,036,079 | B2 | 7/2018 | Terazawa et al. | |
| 10,450,627 | B2 | 10/2019 | Ichimiya et al. | |
| 2002/0179206 | A1 | 12/2002 | Fujita et al. | |
| 2016/0017456 | A1 | 1/2016 | Terazawa et al. | |
| 2016/0040274 | A1* | 2/2016 | Terazawa | C22C 38/12 148/645 |
| 2021/0054471 | A1* | 2/2021 | Yasuda | C22C 38/46 |

FOREIGN PATENT DOCUMENTS

| | | | |
|---|---|---|---|
| CN | 102282281 | A | 12/2011 |
| CN | 103946410 | A | 7/2014 |
| CN | 104105810 | A | 10/2014 |
| CN | 104272084 | A | 1/2015 |
| CN | 104651714 | A | 5/2015 |
| CN | 105008574 | A | 10/2015 |
| CN | 105579602 | A | 5/2016 |
| CN | 106282488 | A | 1/2017 |
| CN | 106574316 | A | 4/2017 |
| EP | 2385149 | A1 | 11/2011 |
| EP | 2784168 | A1 | 10/2014 |
| EP | 2975148 | A1 | 1/2016 |
| EP | 2784168 | B1 | 11/2016 |
| JP | S60152626 | A | 8/1985 |
| JP | S60184663 | A | 9/1985 |
| JP | S61253344 | A | 11/1986 |
| JP | H0353367 | B2 | 8/1991 |
| JP | H04165015 | A | 6/1992 |
| JP | H05186823 | A | 7/1993 |
| JP | 2007302908 | A | 11/2007 |

(Continued)

OTHER PUBLICATIONS

Apr. 2, 2020, the Extended European Search Report issued by the European Patent Office in the corresponding European Patent Application No. 18805692.3.

(Continued)

*Primary Examiner* — Jie Yang

(74) *Attorney, Agent, or Firm* — Kenja IP Law PC

(57) ABSTRACT

Excellent CTOD properties for multilayer welding joint is provided for a steel plate. The steel plate comprises a specific chemical composition with Ceq of 0.45% or less where Ceq (%)=[C]+[Mn]/6+([Cu]+[Ni])/15+([Cr]+[Mo]+[V])/5 . . . (1) and Pcm of 0.22% or less where Pcm (%)=[C]+[Si]/30+([Mn]+[Cu]+[Cr])/20+[Ni]/60+[Mo]/15+[V]/10+5 [B] . . . (2); an average effective grain size of 20 μm or less at a mid-thickness part of the steel plate; and porosities having an equivalent circular diameter of 200 μm or more, the number of the porosities per $mm^2$ being $0.1/mm^2$ or less.

4 Claims, No Drawings

(56) References Cited

FOREIGN PATENT DOCUMENTS

| | | | |
|---|---|---|---|
| JP | 2008095152 | A | 4/2008 |
| JP | 2010106298 | A | 5/2010 |
| JP | 4700769 | B2 | 6/2011 |
| JP | 2012184500 | A | 9/2012 |
| JP | 5201301 | B1 | 6/2013 |
| KR | 1020150126031 | A | 11/2015 |
| WO | 2014141632 | A1 | 9/2014 |
| WO | 2016009595 | A1 | 1/2016 |
| WO | 2018216665 | A1 | 11/2018 |

OTHER PUBLICATIONS

Feb. 16, 2021, Office Action issued by the Korean Intellectual Property Office in the corresponding Korean Patent Application No. 10-2019-7033951 with English language concise statement of relevance.

Jan. 19, 2021, Office Action issued by the China National Intellectual Property Administration in the corresponding Chinese Patent Application No. 201880031723.4 with English language search report.

Wei Sun et al., 900 Questions and Answers of Medium Plate Production, Jul. 2014.

Aug. 14, 2018, International Search Report issued in the International Patent Application No. PCT/JP2018/019553.

Dec. 4, 2020, Communication pursuant to Article 94(3) EPC issued by the European Patent Office in the corresponding European Patent Application No. 18805692.3.

* cited by examiner

STEEL PLATE AND METHOD OF PRODUCING SAME

TECHNICAL FIELD

This disclosure relates to a steel plate, in particular, a steel plate exhibiting excellent properties in a CTOD test in which a notch position is located either in CGHAZ or at a SC/IC-HAZ boundary, and exhibiting excellent joint CTOD properties in multilayer welding, the steel plate being suitably used in ships, marine structures, line pipes, pressure vessels, and the like. Further, this disclosure relates to a method of producing the same.

BACKGROUND

The Charpy test has been conventionally used to evaluate toughness of steel. However, in recent years, as a method of evaluating breakage resistance with higher accuracy, Crack Tip Opening Displacement Test (hereinafter, referred to as "CTOD test") is often used for steel plates used in structures.

The CTOD test evaluates the resistance to occurrence of brittle fracture by introducing a fatigue precrack into a test piece at the location to be evaluated for toughness, subjecting the test piece to a bend test at low temperature, and measuring the amount of the crack opening (plastic deformation volume) immediately before fracture.

In welding a steel plate to be applied to structures, multilayer welding is typically used. A heat-affected zone of multilayer welding (hereinafter, referred to as "multilayer-weld HAZ") is known to have a zone having significantly low toughness (ICCGHAZ: Inter-Critically reheated Coarse Grain heat Affected Zone), which is generated because a zone near a weld line having had a coarse microstructure through a preceding welding pass (CGHAZ: Coarse Grain Heat Affected Zone) is reheated into a ferrite-austenite dual phase region by a welding pass of a next layer, generating a coarse matrix in which a martensite austenite constituent (MA) microstructure is mixed.

A joint CTOD test is basically performed over the entire thickness of a steel plate. Thus, when multilayer-weld HAZ is tested, a region to be evaluated into which a fatigue precrack is introduced includes an ICCGHAZ microstructure. Meanwhile, joint CTOD properties obtained by a joint CTOD test depend on toughness of a most embrittled part of an evaluated region. Thus, joint CTOD properties of multilayer-weld HAZ reflect toughness not only of a CGHAZ microstructure but also of an ICCGHAZ microstructure. Therefore, to improve joint CTOD properties of multilayer-weld HAZ, toughness of an ICCGHAZ microstructure needs to be enhanced.

Conventionally, to improve toughness of the heat-affected zone (HAZ), a technique that incorporates TiN in steel by fine particle distribution to reduce coarsening of austenite grains of CGHAZ and to create ferrite nucleation sites has been put into practical use.

Further, a technique for adding REM (rare earth metal) and dispersing the resulting REM-based acid sulfide to prevent austenite grain growth, a technique for adding Ca and dispersing the resulting Ca-based acid sulfide to prevent austenite grain growth, and a technique for combining the capability of ferrite nucleation of BN with oxide dispersion have been also used.

For example, JP H03-053367 B (PTL 1) and JP S60-184663 A (PTL 2) propose a technique for preventing coarsening of an austenite microstructure of HAZ by REM and TiN particles. JP 2012-184500 A (PTL 3) proposes a technique for improving toughness of HAZ by using CaS and a technique for improving toughness of base metal by hot rolling.

Further, for preventing a decrease in toughness of ICCG-HAZ, a technique for reducing contents of C and Si to thereby prevent formation of MA, and further adding Cu to thereby improve strength of base metal is proposed (for example, JP H05-186823 A (PTL 4)). JP S61-253344 A (PTL 5) proposes a technique for using BN as a ferrite nucleation site in a heat-affected zone of large-heat input welding to refine a HAZ microstructure and improve toughness of HAZ.

Joint CTOD properties at an extremely low temperature range are recently required. For example, JP 4700769 B (PTL 6) proposes a technique for defining a compositional range to decrease nonmetallic inclusions and to control hardness, ensuring joint CTOD properties at −60° C. JP 5201301 B (PTL 7) proposes a technique for finely dispersing Ti oxides and using them as nuclei to thereby refine the microstructure of a heat-affected zone, improving CTOD properties at −80° C.

CITATION LIST

Patent Literatures

PTL 1: JP H03-053367 B
PTL 2: JP S60-184663 A
PTL 3: JP 2012-184500 A
PTL 4: JP H05-186823 A
PTL 5: JP S61-253344 A
PTL 6: JP 4700769 B
PTL 7: JP 5201301 B

SUMMARY

Technical Problem

In the standard defining joint CTOD properties (for example, API (American Petroleum Institute) Standard, RP (Recommended Practice)-2Z)), the temperature of CTOD specifications is typically −10° C. Meanwhile, to respond to the growing demand for energy in recent years and ensure new resources, a region of constructions such as marine structures is shifted to a cold area where resource development has been impossible. Therefore, demand for steel materials has been increased which can be used at temperature of CTOD specifications which is lower than the temperature of CTOD specifications defined by API Standard (hereinafter, also referred to as "special CTOD specifications at low temperature").

Examination by the inventors indicates that conventional techniques as described in PTL 1 to PTL 6 cannot sufficiently satisfy joint CTOD properties which are required of multilayer weld joints for special CTOD specifications at low temperature which are demanded in recent years.

For example, the technique for preventing coarsening of an austenite microstructure of HAZ by REM and TiN particles as proposed in PTL 1 and PTL 2 is not effective sufficiently at preventing austenite grain growth because TiN is dissolved in bond which reaches a high temperature in welding.

On the other hand, REM-based acid sulfide and Ca-based acid sulfide are effective at preventing austenite grain growth. However, only the effect of improving toughness by preventing coarsening of austenite grains of HAZ cannot achieve the joint CTOD properties at temperature of low-temperature specifications.

Further, the capability of ferrite nucleation of BN is effective when a cooling rate of a heat-affected zone is slow in large-heat input welding and the HAZ microstructure is mainly composed of ferrite. However, in the case of a steel plate, because the amount of alloy elements contained in the base metal is relatively high while the heat input in multilayer welding is relatively small, the HAZ microstructure is mainly composed of bainite, and the BN effect is not achieved.

The technique proposed in PTL 3 can satisfy joint CTOD properties at temperature of normal specifications (−10° C.). However, PTL 3 does not examine joint CTOD properties at temperature of low-temperature specifications as described above.

Similarly, PTL 4 does not examine joint CTOD properties at temperature of low-temperature specifications as described above, and it is conceivable that only improving toughness of ICCGHAZ by decreasing the chemical composition of the base metal cannot fulfill specific CTOD specifications at low temperature. Further, decreasing contents of alloying elements of the base metal to improve toughness of ICCGHAZ may deteriorate properties of the base metal. Thus, it is difficult to apply the technique of PTL 4 to steel plates used for marine structures.

The technique proposed in PTL 5 is effective when a cooling rate of a heat-affected zone is slow as in large-heat input welding and the HAZ microstructure is mainly composed of ferrite. However, in the case of a steel plate, the amount of alloy elements contained in the base metal is relatively high and the heat input in multilayer welding is relatively small. Therefore, in multilayer welding of steel plates, the HAZ microstructure is mainly composed of bainite, and the aforementioned effect is not achieved.

On the other hand, the techniques of PTL 6 and PTL 7 are proposed to satisfy joint CTOD properties at a low temperature range, and thus the techniques are considered to be effective. However, it is very difficult to obtain composition which satisfies a $P_{CTOD}$ value needed to exhibit the effect.

Thus, it cannot be said that a technique has been established which stably improves toughness of CGHAZ and ICCGHAZ in a heat-affected zone of multilayer welding of a steel plate, and it is difficult to improve joint CTOD properties when a notch position is located in a bond having CGHAZ and ICCGHAZ in a mixed manner.

It could thus be helpful to provide a steel plate exhibiting excellent joint CTOD properties in multilayer welding. Further, it could also be helpful to provide a method of producing the steel plate.

Solution to Problem

To achieve the aforementioned object, the inventors have thought again a method of improving CTOD properties.

Major methods of preventing brittle fracture include the following:

(1) decreasing defects existing in a steel plate;

(2) decreasing phases which have been hardened by, for example, concentration of composition;

(3) decreasing coarse inclusions; and (4) refining effective crystal grains.

Findings obtained by examining the aforementioned (1) to (4) are explained below.

(1) As to defects inside of a steel plate, it is conceivable that porosities (pores) which have been generated in slab manufacturing processes remain without being perfectly compressed during rolling, which may cause fracture. As a result of examination, the inventors found that it is effective at surely decreasing porosities to perform hot rolling with an average rolling reduction of 10% or more per pass and a cumulative rolling reduction of 20% or more in a high temperature range in which the temperature of a mid-thickness part is 1050° C. or higher.

(2) The inventors found that to decrease hardened phases which are generated by concentration of composition, it is effective to strictly control contents of C and P which are especially easily concentrated. Further, when the amount of alloying elements to be added is large, the alloying elements are easily concentrated. Thus, the inventors found that by controlling an equivalent carbon content Ceq and weld cracking parameter Pcm in a specific range, toughness of the matrix of HAZ of multilayer welding can be improved.

(3) Generally, in an element segregation region of a mid-thickness part of a slab, alloying elements are concentrated and thus coarse inclusions are dispersed in low density. However, the inventors found that by performing rolling at a cumulative rolling reduction of 30% or more in a temperature range in which the temperature of a mid-thickness part is lower than 1050° C. to 950° C. or higher, it is possible to increase strain introduced to the mid-thickness part to thereby elongate coarse inclusions and divide them, thus dispersing refined inclusions in high density. As the result, an effect of improving toughness of HAZ by inclusions can be guaranteed, and additionally, good CTOD properties which can fulfill special CTOD specifications can be achieved.

(4) The inventors examined joint CTOD properties at a SC/ICHAZ (Sub-Critically reheated HAZ/Inter-Critically reheated HAZ) boundary which is a boundary of the transformed area and the non-transformed area of base metal in welding, the joint CTOD properties being required in EN10225(2009) of British Standard and RP-2Z(2005) of API Standard. As the result, the inventors found that because toughness of base metal are dominant over joint CTOD properties of a SC/ICHAZ boundary, to satisfy joint CTOD properties at a test temperature of −60° C. at a SC/ICHAZ boundary, it is necessary to make an effective grain size in a microstructure of base metal to be 20 μm or less and improve toughness of base metal by such crystal grain refinement.

This disclosure is based on the aforementioned findings and further studies. We provide the following.

1. A steel plate comprising:

a chemical composition containing (consisting of), in mass %,

C: 0.01% to 0.07%,
Si: 0.5% or less,
Mn: 1.0% to 2.0%,
P: 0.01% or less,
S: 0.0005% to 0.0050%,
Al: 0.030% or less,
Ni: 0.5% to 2.0%,
Ti: 0.005% to 0.030%,
N: 0.0015% to 0.0065%,
O: 0.0010% to 0.0050%, and
Ca: 0.0005% to 0.0060%, with a balance being Fe and inevitable impurities; and having Ceq of 0.45% or less, where Ceq is defined by the following Formula (1):

$$Ceq\ (\%)=[C]+[Mn]/6+([Cu]+[Ni])/15+([Cr]+[Mo]+[V])/5 \quad (1);\ \text{and}$$

having Pcm of 0.22% or less, where Pcm is defined by the following Formula (2):

$$Pcm\ (\%)=[C]+[Si]/30+([Mn]+[Cu]+[Cr])/20+[Ni]/60+[Mo]/15+[V]/10+5[B] \quad (2),$$

where the brackets in Formula (1) and Formula (2) indicate a content by mass % of an element enclosed in the brackets and have a value of 0 if such an element is not contained;

an average effective grain size of 20 μm or less at a mid-thickness part of the steel plate, and porosities having an equivalent circular diameter of 200 μm or more, the number of the porosities per $mm^2$ being $0.1/mm^2$ or less.

2. The steel plate according to 1., wherein the chemical composition further contains, in mass %, at least one element selected from the group consisting of Cu: 0.05% to 2.0%, Cr: 0.05% to 0.30%, Mo: 0.05% to 0.30%, Nb: 0.005% to 0.035%, V: 0.01% to 0.10%, W: 0.01% to 0.50%, B: 0.0005% to 0.0020%, REM: 0.0020% to 0.0200%, and Mg: 0.0002% to 0.0060%.

3. A method of producing a steel plate, comprising:

heating a slab having the chemical composition according to 1. or 2. to 1050° C. or higher and 1200° C. or lower;

hot rolling the heated slab to obtain a hot-rolled steel plate;

cooling the hot-rolled steel plate to a stop cooling temperature of 600° C. or lower under a condition of at an average cooling rate of 3° C./sec to 50° C./sec while a mid-thickness part of the hot-rolled steel plate has a temperature from 700° C. to 550° C., wherein the hot rolling comprises:

(1) rolling with an average rolling reduction of 10% or more per pass and a cumulative rolling reduction of 20% or more when the temperature at a mid-thickness part of the heated slab is 1050° C. or higher to obtain a heated plate;

(2) rolling with a cumulative rolling reduction of 30% or more when the temperature at the mid-thickness part of the heated plate is lower than 1050° C. and 950° C. or higher; and (3) rolling with an average rolling reduction of 8% or more per pass and a cumulative rolling reduction of 60% or more when the temperature at the mid-thickness part of the heated plate is lower than 950° C.

4. The method of producing a steel plate according to 3., wherein a tempering treatment is performed at a temperature of 700° C. or lower after the cooling.

Advantageous Effect

According to this disclosure, it is possible to obtain a steel plate exhibiting excellent joint CTOD properties in multilayer welding. As used herein, exhibiting excellent joint CTOD properties in multilayer welding means that the amount of crack opening displacement (δ) at a test temperature of −60° C. is 0.30 mm or more in each of CGHAZ (bond) and SC/ICHAZ in which a notch position is located.

DETAILED DESCRIPTION

The reasons for limitations placed on the features of this disclosure are explained.

[Chemical Composition]

The reasons for limiting the chemical composition of the steel plate and the slab to the aforementioned range in this disclosure are described first. In the description of the chemical composition, "%" denotes "mass %" unless otherwise noted.

C: 0.01% to 0.07%

C is an element that improves strength of steel. The content of C needs to be 0.01% or more. On the other hand, an excessively high C content increases hardness of a portion where C has been concentrated, deteriorating joint CTOD properties. However, the C content of 0.07% or less does not deteriorate joint CTOD properties even if C is concentrated. Therefore, the C content is set to 0.07% or less, preferably 0.05% or less, and more preferably 0.45% or less.

Si: 0.5% or Less

Si is an element which is inevitably contained as impurities and has an action of improving strength. However, an excessively high Si content beyond 0.5% deteriorates joint CTOD properties. Accordingly, the Si content is set to 0.5% or less, preferably 0.2% or less, and more preferably less than 0.15%. On the other hand, because the smaller the Si content is the better for improving joint CTOD properties, the Si content has no specific lower limit and may be 0%. However, excessively reducing the Si content incurs higher manufacturing costs. Thus, the Si content is preferably set to 0.005% or more.

Mn: 1.0% to 2.0%

Mn is an element having an effect of improving strength through improvement of quench hardenability of steel. To obtain this effect, the Mn content is set to 1.0% or more and preferably 1.2% or more. On the other hand, an excessively high Mn content significantly deteriorates joint CTOD properties. Therefore, the Mn content is set to 2.0% or less and preferably 1.8% or less.

P: 0.01% or Less

P is an element which is inevitably contained in steel as impurities and deteriorates toughness of steel. Therefore, it is desirable to reduce the P content as much as possible. In particular, in this disclosure, the P content needs to be controlled more strictly than usual to ensure joint CTOD properties at low temperature. Specifically, the P content is set to 0.01% or less and preferably 0.008% or less. On the other hand, the P content has no specific lower limit and may be 0%. However, excessively reducing the P content incurs higher manufacturing costs. Therefore, the P content is preferably set to 0.001% or more.

S: 0.0005% to 0.0050%

S is an element necessary to form inclusions which improve toughness of multilayer-weld HAZ. Therefore, the S content is set to 0.0005% or more. On the other hand, the S content beyond 0.0050% deteriorates joint CTOD properties. Thus, the S content is set to 0.0050% or less and preferably 0.0045% or less.

Al: 0.030% or Less

An excessively high Al content deteriorates joint CTOD properties. In particular, the Al content beyond 0.030% deteriorates joint CTOD properties at a low temperature range. Therefore, the Al content is set to 0.030% or less. On the other hand, the Al content has no specific lower limit and may be 0%. However, excessively reducing the Al content incurs higher manufacturing costs. Therefore, the Al content is preferably set to 0.001% or more.

Ni: 0.5% to 2.0%

Ni is an element which can increase strength of a steel plate without significantly deteriorating toughness of both base metal and joints. To obtain this effect, Ni is necessary to be added in an amount of 0.5% or more. Therefore, the Ni content is set to 0.5% or more. On the other hand, when the Ni content is beyond 2.0%, the effect of increasing strength becomes saturated, incuring higher costs. Therefore, the Ni content is set to 2.0% or less and preferably 1.8% or less.

Ti: 0.005% to 0.030%

Ti precipitates in steel as TiN. The precipitated TiN has an action of preventing coarsening of austenite grains in HAZ, and thus, refines the HAZ microstructure, improving toughness. To obtain this effect, the Ti content is set to 0.005% or more. On the other hand, the Ti content beyond 0.030% causes precipitation of solute Ti and coarse TiC, ending up deteriorating toughness of a heat-affected zone. Therefore, the Ti content is set to 0.030% or less and preferably 0.025% or less.

N: 0.0015% to 0.0065%

N precipitates in steel as TiN. The precipitated TiN has an action of preventing coarsening of austenite grains in HAZ, and thus, refines the HAZ microstructure, improving toughness. To obtain this effect, the N content is set to 0.0015% or more. On the other hand, the N content beyond 0.0065% rather deteriorates toughness of a heat-affected zone. Therefore, the N content is set to 0.0065% or less and preferably 0.0055% or less.

O: 0.0010% to 0.0050%

O is an element necessary to form inclusions which improve toughness of multilayer-weld HAZ. Therefore, the O content is set to 0.0010% or more. On the other hand, the O content beyond 0.0050% rather deteriorates joint CTOD properties. Therefore, the O content is set to 0.0050% or less and preferably 0.0045% or less.

Ca: 0.0005% to 0.0060%

Ca is an element necessary to form inclusions which improve toughness of multilayer-weld HAZ. Therefore, the Ca content is set to 0.0005% or more and preferably 0.0007% or more. On the other hand, the Ca content beyond 0.0060% rather deteriorates joint CTOD properties. Therefore, the Ca content is set to 0.0060% or less and preferably 0.0050% or less.

The chemical composition of a steel plate in one embodiment may consist of the aforementioned elements with the balance being Fe and inevitable impurities.

Further, in other embodiments, to further improve strength, toughness adjustment, and joint toughness, the chemical composition can further optionally contain at least one selected from the group consisting of Cu, Cr, Mo, Nb, V, W, B, REM, and Mg with the following contents.

Cu: 0.05% to 2.0%

Cu is an element which can increase strength of a steel plate without significantly deteriorating toughness of base metal and joints. In the case of adding Cu, to obtain this effect, the Cu content is set to 0.05% or more and preferably 0.1% or more. On the other hand, when the Cu content is beyond 2.0%, steel plate cracks may be caused by a Cu-concentrated layer which generates directly below scales. Therefore, in the case of adding Cu, the Cu content is set to 2.0% or less and preferably 1.5% or less.

Cr: 0.05% to 0.30%

Cr is an element having the effect of improving strength through improvement of quench hardenability of steel. In the case of adding Cr, to obtain this effect, the Cr content is set to 0.05% or more. On the other hand, an excessively high Cr content deteriorates joint CTOD properties. Thus, in the case of adding Cr, the Cr content is set to 0.30% or less.

Mo: 0.05% to 0.30%

Mo is an element having the effect of improving strength through improvement of quench hardenability of steel. In the case of adding Mo, to obtain this effect, the Mo content is set to 0.05% or more. On the other hand, an excessively high Mo content deteriorates joint CTOD properties. Thus, in the case of adding Mo, the Mo content is set to 0.30% or less.

Nb: 0.005% to 0.035%,

Nb is an element which widens a non-recrystallization temperature range of an austenite phase. Therefore, the addition of Nb is effective at efficiently rolling a non-recrystallization region to obtain a fine grain microstructure. In the case of adding Nb, to obtain this effect, the Nb content is set to 0.005% or more. On the other hand, the Nb content beyond 0.035% deteriorates joint CTOD properties. Thus, in the case of adding Nb, the Nb content is set to 0.035% or less.

V: 0.01% to 0.10%

V is an element of improving strength of base metal, and the addition of V of 0.01% or more achieves the effect. Therefore, in the case of adding V, the V content is set to 0.01% or more and preferably 0.02% or more. On the other hand, the V content beyond 0.10% deteriorates toughness of HAZ. Thus, in the case of adding V, the V content is set to 0.10% or less and preferably 0.05% or less.

W: 0.01% to 0.50%

W is an element of improving strength of base metal, and the addition of W of 0.01% or more achieves the effect. Therefore, in the case of adding W, the W content is set to 0.01% or more and preferably 0.05% or more. On the other hand, the W content beyond 0.50% deteriorates toughness of HAZ. Thus, in the case of adding W, the W content is set to 0.50% or less and preferably 0.35% or less.

B: 0.0005% to 0.0020%

B is an element which improves quench hardenability with very small amount thereof, thereby increasing strength of a steel plate. In the case of adding B, to obtain this effect, the B content is set to 0.0005% or more. On the other hand, the B content beyond 0.0020% deteriorates toughness of HAZ. Thus, in the case of adding B, the B content is set to 0.0020% or less.

REM: 0.0020% to 0.0200%

REM (rare-earth metal) forms acid sulfide-based inclusions to thereby prevent austenite grain growth of HAZ, improving toughness of HAZ. In the case of adding REM, to obtain this effect, the REM content is set to 0.0020% or more. On the other hand, the REM content beyond 0.0200% rather deteriorates toughness of base metal and HAZ. Therefore, in the case of adding REM, the REM content is set to 0.0200% or less.

Mg: 0.0002% to 0.0060%

Mg is an element which forms oxide-based inclusions to thereby prevent austenite grain growth in a heat-affected zone, improving toughness of the heat-affected zone. In the case of adding Mg, to obtain this effect, the Mg content is set to 0.0002% or more. On the other hand, when the Mg content is beyond 0.0060%, the addition effect becomes saturated, and thus an effect commensurate with the content is not offered, which is economically disadvantageous. Therefore, in the case of adding Mg, the Mg content is set to 0.0060% or less.

The chemical composition of the steel plate and the slab needs to satisfy the following conditions.

Ceq: 0.45% or Less

When the equivalent carbon content, Ceq defined by the following Formula (1) is increased, a HAZ microstructure has an increased amount of microstructure having poor toughness such as martensite austenite constituent and bainite, thus deteriorating toughness of HAZ. Ceq beyond 0.45% deteriorates toughness of the matrix itself of HAZ. Thus, even with a technique for improving toughness of HAZ by inclusions, necessary joint CTOD properties cannot be satisfied. Therefore, Ceq is set to 0.45% or less. On the other hand, Ceq has no specific lower limit, but Ceq is preferably set to 0.25% or more and more preferably 0.30% or more.

$$Ceq\ (\%)=[C]+[Mn]/6+([Cu]+[Ni])/15+([Cr]+[Mo]+[V])/5 \quad (1)$$

Pcm: 0.22% or Less

When the weld cracking parameter, Pcm defined by the following Formula (2) is increased, a HAZ microstructure has increased microstructure having poor toughness such as martensite austenite constituent and bainite, thus deteriorating toughness of HAZ. Pcm beyond 0.22% deteriorates toughness of the matrix itself of HAZ. Thus, necessary joint CTOD properties cannot be achieved. Therefore, Pcm is set to 0.22% or less. On the other hand, Pcm has no specific lower limit, but Pcm is preferably 0.10% or more and more preferably 0.12% or more.

$$Pcm\ (\%)=[C]+[Si]/30+([Mn]+[Cu]+[Cr])/20+[Ni]/60+[Mo]/15+[V]/10+5[B] \quad (2)$$

The brackets in Formula (1) and Formula (2) indicate content by mass % of an element enclosed in the brackets and have a value of 0 if an element enclosed in the brackets is not contained.

[Average Effective Grain Size]

Average Effective Grain Size: 20 μm or Less

In this disclosure, an average effective grain size of a microstructure in a mid-thickness part of a steel plate is set to 20 μm or less. Crystal grains in the mid-thickness part in which segregation is easily caused are refined as described above to improve toughness of base metal, thereby increasing joint CTOD properties at a SC/ICHAZ boundary. On the other hand, the smaller the average effective grain size is the more advantageous. Thus, the average effective grain size has no specific lower limit, but generally, the lower limit is about 1 μm. As used herein, the "effective grain size" is defined as an equivalent circular diameter of a crystal grain surrounded with a large-angle grain boundary having an orientation difference of 15° or more from an adjacent crystal grain. Further, the average effective grain size in the mid-thickness part can be measured by a method described in the following Examples.

[Number Density of Porosities]

Number Density of Porosities: 0.1/Mm$^2$ or Less

As stated above, a porosity that remains in a steel plate becomes a fracture origin, thus deteriorating CTOD properties. In particular, when the number of porosities having an equivalent circular diameter of 200 μm or more per mm$^2$ (hereinafter, simply referred to as "number density of porosities") is more than 0.1/mm$^2$, it is extremely highly likely that the amount of crack opening displacement (δ) in a CTOD test becomes insufficient. It is therefore important to limit the number density of porosities to 0.1/mm$^2$ or less. As used herein, the number density of porosities means an average number density in full thickness×full width in a cross section parallel to a plate transverse direction of a steel plate (cross section perpendicular to the rolling direction). The number density of porosities can be measured by a method described in the following Examples.

[Plate Thickness]

As used herein, the "steel plate" means a steel plate having a thickness of 6 mm or more in accordance with the common definition in the technical field. The plate thickness of the steel plate is preferably 20 mm or more, and more preferably 30 mm or more. On the other hand, the plate thickness has no specific upper limit, but it is preferably 100 mm or less.

[Production Method]

The following describes a method of producing a steel plate according to one embodiment. Our steel plate can be produced by hot rolling a slab having the aforementioned chemical composition under the conditions as described above to obtain a hot-rolled steel plate, and then cooling the hot-rolled steel plate. After the cooling, the steel plate may be arbitrarily subjected to tempering treatment.

The following describes each of the steps. In the following description, "temperature" means a temperature in a mid-thickness part, unless otherwise noted. A temperature in a mid-thickness part can be measured as in the following Examples. However, for example, on an actual production line, a temperature of a surface of a steel plate is measured using a radiation thermometer and from the temperature of a surface of a steel plate, a temperature in a mid-thickness part may be determined by heat transfer calculation.

[Slab]

Any slab having the aforementioned chemical composition can be used. The slab can be produced by, for example, continuous casting.

Heating Temperature: 1050° C. to 1200° C.

Before the hot rolling, the slab is heated to a heating temperature of 1050° C. or higher and 1200° C. or lower. When the heating temperature is lower than 1050° C., the following conditions of hot rolling cannot be met, and a sufficient effect cannot be obtained. Thus, the heating temperature is set to 1050° C. or higher and preferably 1070° C. or higher. On the other hand, when the heating temperature is higher than 1200° C., austenite grains become coarse, and thus a desired fine grain microstructure cannot be obtained after the hot rolling. Thus, the heating temperature is set to 1200° C. or lower and preferably 1170° C. or lower.

[Hot Rolling]

Then, the heated slab is hot rolled to obtain a hot-rolled steel plate. During the hot rolling, it is important to control hot-rolling conditions in both a recrystallization temperature range and a non-recrystallization temperature range. Specifically, the hot rolling consists of the following three stages:

(1) rolling with an average rolling reduction of 10% or more per pass and a cumulative rolling reduction of 20% or more when the temperature at a mid-thickness part of the heated slab is 1050° C. or higher to obtain a heated plate;

(2) rolling with a cumulative rolling reduction of 30% or more when the temperature at the mid-thickness part of the heated plate is lower than 1050° C. to 950° C. or higher; and (3) rolling with an average rolling reduction of 8% or more per pass and a cumulative rolling reduction of 60% or more when the temperature at the mid-thickness part of the heated plate is lower than 950° C.

In the hot rolling, the hot rolling of (1) to (3) may be performed sequentially. The reasons for limiting hot-rolling conditions in each stage are described below. The cumulative rolling reduction in each temperature range refers to a cumulative value of rolling reduction in the corresponding temperature range.

(1) Temperature of a Mid-Thickness Part: 1050° C. or Higher

First, the slab is hot rolled in a temperature range of 1050° C. or higher which is a high temperature part of a recrystallization temperature range. The heating temperature of the slab is 1200° C. or lower, and thus, the temperature of a mid-thickness part of the slab is also 1200° C. or lower during the hot rolling. The hot-rolling conditions in the temperature range are an average rolling reduction per pass of 10% or more and a cumulative rolling reduction of 20% or more. It is thus possible to significantly decrease porosities which, if any, can become an origin of fracture. The average rolling reduction per pass in this temperature range has no specific upper limit, but is preferably 30% or less, and more preferably 25% or less. Further, the cumulative rolling reduction in this temperature range has no specific upper limit, but is preferably 80% or less, and more preferably 70% or less.

(2) Temperature of the Mid-Thickness Part: Lower than 1050° C. to 950° C. or Higher Next, hot rolling is performed in a temperature range of lower than 1050° C. to 950° C. or higher. The hot-rolling conditions in the temperature range are a cumulative rolling reduction of 30% or more. The hot rolling is performed in the temperature range to produce recrystallization, thereby fining the microstructure after the recrystallization, and to refine and disperse coarse inclusions. Hot rolling at lower than 950° C. hardly produces recrystallization and causes insufficient refinement of austenite grains. Thus, hot rolling at 950° C. or higher is necessary. The cumulative rolling reduction in the temperature range has no specific upper limit, but is preferably 70% or less, and more preferably 60% or less.

(3) Temperature of the Mid-Thickness Part: Lower than 950° C.

Next, hot rolling is performed in a temperature range of lower than 950° C. which is a non-recrystallization temperature range. The hot-rolling conditions in the temperature range are an average rolling reduction per pass of 8% or more and a cumulative rolling reduction of 60% or more. As used herein, steel is hardly recrystallized by hot rolling at lower than 950° C. Therefore, strain introduced by hot rolling is not consumed in recrystallization but accumulated, serving as nucleation sites in the subsequent cooling step. As the result, the finally obtained steel plate can have a refined microstructure. When the cumulative rolling reduction in the temperature range is less than 60%, the effect of refining crystal grains in the whole steel plate becomes insufficient. Further, when the average rolling reduction per pass in the temperature range is less than 8%, sufficient rolling reduction cannot be achieved in the mid-thickness part, and a sufficient effect of refining crystal grains cannot be obtained especially in the mid-thickness part. Therefore, when the aforementioned conditions are not met, variations of properties depending on a position in a plate thickness direction are more increased. The average rolling reduction per pass in the temperature range has no specific upper limit, but is preferably 25% or less and more preferably 20% or less. Further, the cumulative rolling reduction in the temperature range has no specific upper limit, but is preferably 90% or less and more preferably 80% or less.

[Cooling]

After completion of the hot rolling, the obtained hot-rolled steel plate is cooled. The cooling can be performed by any method if the following conditions are met. For example, the cooling can be performed by water cooling.

Average Cooling Rate: 3° C./Sec to 50° C./Sec

In the cooling, an average cooling rate when the temperature of a mid-thickness part of the hot-rolled steel plate is 700° C. to 550° C. (hereinafter, simply referred to as "average cooling rate") is 3° C./sec to 50° C./sec. The average cooling rate less than 3° C./sec generates a coarse ferrite phase in the microstructure of base metal, thus deteriorating CTOD properties of SC/ICHAZ. On the other hand, the average cooling rate more than 50° C./sec increases strength of base metal, thus deteriorating CTOD properties of SC/ICHAZ.

Stop Cooling Temperature: 600° C. or Lower

In the cooling, the hot-rolled steel plate is cooled to a stop cooling temperature which is 600° C. or lower in terms of temperature of the mid-thickness part of the hot-rolled steel plate. A stop cooling temperature higher than 600° C. causes insufficient transformation strengthening by cooling, leading to inadequate strength of base metal. On the other hand, the stop cooling temperature has no specific lower limit, and the steel plate can be cooled to any temperature. However, typically, the lower limit of the stop cooling temperature is room temperature or temperature of water which is used for cooling.

[Tempering Treatment]

After the cooling, the steel plate may be arbitrarily subjected to tempering treatment. The tempering treatment can lower strength of base metal and further improve toughness. At that time, a tempering temperature higher than 700° C. generates a coarse ferrite phase, thus deteriorating toughness of SCHAZ. Therefore, the tempering temperature is set to 700° C. or lower. The tempering temperature is preferably set to 650° C. or lower. On the other hand, the tempering temperature has no specific lower limit, but is preferably set to 300° C. or higher.

EXAMPLES

Next, a more detailed description is given below based on Examples. The following Examples merely represent preferred examples, and the disclosure is not limited to these examples.

Slabs having a chemical composition listed in Table 1 were used to produce steel plates under producing conditions listed in Table 2. During hot rolling, a thermocouple was attached in a center position in the longitudinal direction, the width direction and the plate thickness direction of each steel material to be hot rolled to measure the temperature of a mid-thickness part.

The average effective grain size, the number density of porosities, and the yield stress of each obtained steel plate were measured by the following method.

[Average Effective Grain Size]

A sample was collected from each obtained steel plate so that a measurement position was located at a center position in the longitudinal direction, the width direction, and the plate thickness direction of the steel plate. Next, a surface of the sample was mirror polished, and then the sample was subjected to EBSP analysis under the following conditions. From an obtained crystal orientation map, an equivalent circular diameter of a microstructure surrounded by a large-angle grain boundary having an orientation difference of 15° or more from an adjacent crystal grain was determined, and an average of equivalent circular diameters in the following analysis region was defined as an average effective grain size.

(EBSP Conditions)

analysis region: a region of 1 mm×1 mm in a mid-thickness part step size: 0.4 μm

[Number Density of Porosities]

For detection of defects inside of a steel plate, ultrasonic testing is often used because ultrasonic testing can perform nondestructive inspection. However, to precisely check the state of defect parts, the inside of the steel plates were directly observed to measure the number density of porosities. First, as samples for observation, one or two cross sections were collected parallel to the plate transverse direction of each rolled material and then were mirror polished. Next, the obtained sample was observed using an optical microscope and photographed. The obtained photographs were subjected to image analysis to determine an equivalent circular diameter of each porosity which was found in the photographs. The number of porosities having a grain size of 200 μm or more was divided by a measured area (plate thickness×plate width) to thereby determine the number of porosities having an equivalent circular diameter of 200 μm or more per $mm^2$.

[Yield Stress]

A tensile test was performed in accordance with EN10002-1 to determine yield stress (YS) at a position of one quarter in height of the plate thickness (t) in each steel plate. For the tensile test, a round bar tensile test piece having a parallel portion diameter of 14 mm and a parallel portion length of 70 mm was use, the test pieces being collected parallel to the plate transverse direction from a position of one quarter in height of the plate thickness. In the tensile test, when an upper yield point appeared, the upper yield point was determined to be yield stress. Further, when an upper yield point did not appear, a 0.2% proof stress was determined to be yield stress.

Next, each steel plate was used to make a multilayer fill weld joint. Each obtained multilayer fill weld joint was subjected to a joint CTOD test to measure the amount of crack opening displacement in CGHAZ and the amount of crack opening displacement in SC/ICHAZ. Conditions of making a multilayer fill weld joint and conditions of a joint CTOD test are explained below.

[Multilayer Fill Weld Joint]

The multilayer fill weld joint of the steel plate was formed by submerged arc welding (multilayer welding) with heat input of 5.0 kJ/mm and with a K groove (in which one end was in a straight shape and the other end was in a v-bended shape).

[Joint CTOD Test]

The joint CTOD test was performed according to BS Standard EN10225 (2009) to evaluate the amount of crack opening displacement [CTOD value (δ)] at test temperature of −60° C. For the joint CTOD test, a test piece with a square cross section having a size of t×t (t was a plate thickness) was used.

In the joint CTOD test, a test in which a notch position was located in CGHAZ on the straight-form side of the K groove was performed to measure δ of CGHAZ, and a test in which a notch position was located at a SC/ICHAZ boundary was performed to measure δ of the SC/ICHAZ boundary. For each steel plate, the test was performed for three test pieces per notch position and an average of measurement values was δ.

After the test, on a fracture surface of the test piece, the end of a fatigue precrack was confirmed to be located both in CGHAZ and at a SC/ICHAZ boundary specified by EN10225 (2009). In the case of joint CTOD test of multilayer welding, even when a notch position is located in CGHAZ, a certain amount of ICCGHAZ is also involved. Thus, the test result reflects toughness of both CGHAZ and ICCGHAZ.

The measurement results were listed in Table 2. The steel plates satisfying the conditions of this disclosure (Examples) had a CTOD value of 0.30 mm or more both in the CGHAZ and at a SC/ICHAZ boundary, exhibiting excellent joint CTOD properties. On the other hand, the steel plates not satisfying the conditions of this disclosure (Comparative Examples) had a CTOD value of less than 0.30 mm in at least one of the CGHAZ and a SC/ICHAZ boundary, exhibiting lower joint CTOD properties than Examples.

TABLE 1

| Steel sample | Chemical Composition (mass %)* | | | | | | | | | | | | |
|---|---|---|---|---|---|---|---|---|---|---|---|---|---|
| ID | C | Si | Mn | P | S | Al | Ni | Ti | N | O | Ca | Cu | Cr |
| A | 0.06 | 0.15 | 1.7 | 0.008 | 0.0016 | 0.016 | 0.7 | 0.007 | 0.0024 | 0.0024 | 0.0027 | — | — |
| B | 0.04 | 0.26 | 1.4 | 0.004 | 0.0023 | 0.024 | 1.2 | 0.011 | 0.0045 | 0.0039 | 0.0031 | — | — |
| C | 0.05 | 0.05 | 1.8 | 0.007 | 0.0019 | 0.003 | 1.4 | 0.020 | 0.0030 | 0.0038 | 0.0006 | — | 0.05 |
| D | 0.07 | 0.07 | 2.0 | 0.008 | 0.0023 | 0.014 | 0.6 | 0.012 | 0.0053 | 0.0026 | 0.0044 | — | — |
| E | 0.03 | 0.27 | 1.1 | 0.007 | 0.0028 | 0.023 | 2.0 | 0.016 | 0.0027 | 0.0015 | 0.0007 | — | — |
| F | 0.05 | 0.38 | 1.5 | 0.005 | 0.0037 | 0.018 | 1.7 | 0.008 | 0.0021 | 0.0019 | 0.0051 | 0.07 | — |
| G | 0.06 | 0.16 | 1.2 | 0.006 | 0.0018 | 0.022 | 0.6 | 0.006 | 0.0037 | 0.0042 | 0.0055 | — | — |
| H | 0.01 | 0.46 | 1.4 | 0.006 | 0.0007 | 0.004 | 1.1 | 0.027 | 0.0041 | 0.0015 | 0.0031 | — | — |
| J | 0.02 | 0.01 | 1.8 | 0.007 | 0.0044 | 0.014 | 1.7 | 0.015 | 0.0023 | 0.0019 | 0.0014 | — | — |
| K | 0.05 | 0.48 | 1.0 | 0.005 | 0.0027 | 0.023 | 2.0 | 0.027 | 0.0016 | 0.0028 | 0.0024 | — | — |
| L | 0.07 | 0.36 | 1.4 | 0.004 | 0.0037 | 0.028 | 1.7 | 0.024 | 0.0037 | 0.0018 | 0.0033 | — | 0.07 |
| M | 0.06 | 0.28 | 1.7 | 0.007 | 0.0024 | 0.002 | 0.7 | 0.018 | 0.0062 | 0.0017 | 0.0014 | — | — |
| N | 0.03 | 0.17 | 1.9 | 0.006 | 0.0041 | 0.020 | 0.5 | 0.024 | 0.0027 | 0.0025 | 0.0034 | — | — |
| O | 0.15 | 0.35 | 1.2 | 0.007 | 0.0023 | 0.013 | 1.4 | 0.006 | 0.0021 | 0.0035 | 0.0022 | — | — |
| P | 0.22 | 0.20 | 1.0 | 0.005 | 0.0011 | 0.027 | 0.6 | 0.007 | 0.0034 | 0.0027 | 0.0042 | 0.20 | — |
| Q | 0.02 | 0.26 | 2.3 | 0.008 | 0.0015 | 0.021 | 0.5 | 0.018 | 0.0028 | 0.0024 | 0.0021 | — | — |
| R | 0.04 | 0.27 | 1.4 | 0.015 | 0.0066 | 0.001 | 0.8 | 0.011 | 0.0051 | 0.0018 | 0.0021 | — | — |
| S | 0.03 | 0.14 | 1.2 | 0.007 | 0.0022 | 0.036 | 1.8 | 0.028 | 0.0034 | 0.0041 | 0.0044 | — | — |
| T | 0.05 | 0.11 | 1.3 | 0.006 | 0.0016 | 0.017 | 1.7 | 0.007 | 0.0026 | 0.0066 | 0.0033 | — | — |
| U | 0.04 | 0.26 | 1.5 | 0.008 | 0.0027 | 0.021 | 1.1 | 0.013 | 0.0073 | 0.0037 | 0.0014 | — | 0.15 |
| W | 0.06 | 0.44 | 1.4 | 0.007 | 0.0016 | 0.012 | 0.7 | 0.071 | 0.0042 | 0.0027 | 0.0055 | — | — |
| X | 0.04 | 0.11 | 1.7 | 0.008 | 0.0017 | 0.016 | 0.5 | 0.027 | 0.0060 | 0.0034 | 0.0021 | — | — |
| Y | 0.05 | 0.34 | 1.2 | 0.006 | 0.0018 | 0.007 | 1.9 | 0.015 | 0.0022 | 0.0041 | 0.0015 | — | — |
| Z | 0.06 | 0.42 | 1.9 | 0.006 | 0.0022 | 0.025 | 1.8 | 0.025 | 0.0045 | 0.0023 | 0.0015 | — | 0.20 |
| AA | 0.03 | 0.57 | 1.8 | 0.005 | 0.0018 | 0.015 | 0.8 | 0.005 | 0.0019 | 0.0026 | 0.0013 | — | — |
| AB | 0.06 | 0.15 | 1.6 | 0.006 | 0.0021 | 0.007 | 1.1 | 0.034 | 0.0035 | 0.0024 | 0.0026 | — | — |
| AC | 0.07 | 0.05 | 1.7 | 0.005 | 0.0016 | 0.003 | 1.7 | 0.007 | 0.0022 | 0.0017 | 0.0022 | 0.08 | — |
| AD | 0.06 | 0.08 | 1.8 | 0.004 | 0.0015 | 0.025 | 1.2 | 0.015 | 0.0028 | 0.0027 | — | — | 0.08 |

TABLE 1-continued

| Steel sample ID | Chemical Composition (mass %)* Mo | Nb | V | W | B | REM | Mg | Ceq (%) | Pcm (%) | Classification |
|---|---|---|---|---|---|---|---|---|---|---|
| A | — | — | — | — | — | — | — | 0.39 | 0.16 | Conforming Steel |
| B | — | — | — | — | — | — | — | 0.35 | 0.14 | Conforming Steel |
| C | — | — | — | — | — | — | — | 0.45 | 0.17 | Conforming Steel |
| D | — | 0.007 | — | — | — | — | — | 0.44 | 0.18 | Conforming Steel |
| E | — | — | — | — | — | — | — | 0.35 | 0.13 | Conforming Steel |
| F | — | — | 0.05 | — | — | — | — | 0.43 | 0.17 | Conforming Steel |
| G | — | — | — | — | — | — | — | 0.30 | 0.14 | Conforming Steel |
| H | 0.15 | — | — | — | — | — | — | 0.35 | 0.12 | Conforming Steel |
| J | 0.06 | — | — | 0.12 | 0.0011 | — | — | 0.45 | 0.15 | Conforming Steel |
| K | — | — | — | — | — | — | — | 0.35 | 0.15 | Conforming Steel |
| L | — | — | — | — | — | 0.008 | — | 0.43 | 0.18 | Conforming Steel |
| M | — | — | — | — | — | — | — | 0.39 | 0.17 | Conforming Steel |
| N | — | — | 0.05 | — | — | — | 0.002 | 0.39 | 0.14 | Conforming Steel |
| O | — | — | — | — | — | — | — | 0.44 | 0.25 | Comparative Steel |
| P | — | — | — | — | — | — | — | 0.44 | 0.30 | Comparative Steel |
| Q | — | — | — | — | — | — | — | 0.44 | 0.15 | Comparative Steel |
| R | — | — | — | — | — | — | — | 0.33 | 0.13 | Comparative Steel |
| S | — | 0.013 | — | — | — | — | — | 0.35 | 0.12 | Comparative Steel |
| T | — | — | — | 0.11 | — | — | — | 0.38 | 0.15 | Comparative Steel |
| U | — | — | — | — | — | — | — | 0.39 | 0.15 | Comparative Steel |
| W | — | — | — | — | — | 0.008 | — | 0.34 | 0.16 | Comparative Steel |
| X | 0.41 | — | — | — | — | — | — | 0.44 | 0.16 | Comparative Steel |
| Y | — | — | 0.17 | — | — | — | — | 0.41 | 0.17 | Comparative Steel |
| Z | — | — | — | — | — | — | — | 0.54 | 0.21 | Comparative Steel |
| AA | — | 0.07 | — | — | — | — | 0.004 | 0.38 | 0.15 | Comparative Steel |
| AB | — | — | — | 0.41 | — | — | — | 0.40 | 0.16 | Comparative Steel |
| AC | 0.06 | — | — | — | 0.0014 | — | — | 0.48 | 0.20 | Comparative Steel |
| AD | — | — | — | — | — | — | — | 0.44 | 0.18 | Comparative Steel |

*The balance is Fe and inevitable impurities.

TABLE 2

| | | | Producing Conditions | | | | | | | | |
|---|---|---|---|---|---|---|---|---|---|---|---|
| | | | | Hot rolling | | | | | | | |
| | | | | 1050° C. or higher | | lower than 1050° C. to 950° C. or higher | lower than 950° C. | | Cooling | |
| No. | Steel sample ID | Plate thickness (mm) | Heating Heating temperature (° C.) | Cumulative rolling reduction (%) | Average rolling reduction per pass (%) | Cumulative rolling reduction (%) | Cumulative rolling reduction (%) | Average rolling reduction per pass (%) | Average cooling rate *1 (° C./sec) | Stop cooling temperature (° C.) |
| 1 | A | 68 | 1150 | 25 | 13 | 35 | 65 | 10 | 6 | 561 |
| 2 | B | 50 | 1100 | 40 | 15 | 30 | 70 | 13 | 13 | 502 |
| 3 | C | 90 | 1050 | 20 | 20 | 30 | 60 | 8 | 3 | 477 |
| 4 | D | 42 | 1070 | 35 | 14 | 35 | 75 | 10 | 15 | 156 |
| 5 | E | 46 | 1090 | 45 | 18 | 40 | 65 | 12 | 10 | 58 |
| 6 | F | 33 | 1150 | 50 | 11 | 35 | 80 | 10 | 46 | 553 |
| 7 | G | 55 | 1120 | 30 | 15 | 35 | 70 | 15 | 15 | 361 |
| 8 | H | 46 | 1180 | 35 | 20 | 50 | 65 | 8 | 8 | 207 |
| 9 | J | 46 | 1150 | 35 | 14 | 30 | 75 | 13 | 12 | 484 |
| 10 | K | 65 | 1100 | 40 | 15 | 40 | 60 | 10 | 9 | 196 |
| 11 | L | 55 | 1200 | 40 | 16 | 35 | 65 | 17 | 6 | 430 |
| 12 | M | 46 | 1100 | 35 | 11 | 50 | 65 | 9 | 20 | 544 |
| 13 | N | 45 | 1200 | 60 | 17 | 30 | 60 | 19 | 15 | 71 |
| 14 | O | 42 | 1150 | 35 | 15 | 35 | 75 | 12 | 13 | 377 |
| 15 | P | 24 | 1200 | 50 | 14 | 40 | 80 | 15 | 41 | 495 |
| 16 | Q | 57 | 1100 | 35 | 15 | 45 | 60 | 10 | 7 | 181 |
| 17 | R | 68 | 1060 | 30 | 16 | 30 | 65 | 16 | 10 | 384 |
| 18 | S | 59 | 1180 | 40 | 11 | 30 | 65 | 12 | 12 | 517 |
| 19 | T | 50 | 1070 | 45 | 15 | 40 | 70 | 13 | 10 | 473 |
| 20 | U | 23 | 1150 | 55 | 10 | 35 | 80 | 10 | 25 | 273 |

TABLE 2-continued

| | | Measurement Results | | | | | |
|---|---|---|---|---|---|---|---|
| | | Steel plate (base metal) | | | Multilayer fill weld joint | | |
| No. | Producing Conditions Tempering Tempering temperature (° C.) | Number density of porosities *2 (numbers/mm$^2$) | Average effective grain size at a mid-thickness part (μm) | YS at a position of one quarter in height of plate thickness (MPa) | δ of CGHAZ at −60° C. (mm) | δ of a SC/ICHAZ boundary at −60° C. (mm) | Classification |
| 1 | — | 0.06 | 13 | 426 | 0.65 | 0.71 | Example |
| 2 | — | 0.04 | 18 | 436 | 0.88 | 0.57 | Example |
| 3 | — | 0.08 | 14 | 473 | 0.39 | 0.87 | Example |
| 4 | 650 | 0.06 | 19 | 487 | 1.62 | 1.06 | Example |
| 5 | — | 0.07 | 13 | 401 | 0.94 | 0.68 | Example |
| 6 | — | 0.01 | 6 | 496 | 1.27 | 0.94 | Example |
| 7 | — | 0.05 | 11 | 367 | 0.66 | 1.33 | Example |
| 8 | 500 | 0.03 | 17 | 394 | 0.81 | 0.77 | Example |
| 9 | — | 0.08 | 8 | 433 | 0.62 | 0.68 | Example |
| 10 | — | 0.04 | 16 | 409 | 0.34 | 0.56 | Example |
| 11 | 600 | 0.06 | 18 | 480 | 0.45 | 0.76 | Example |
| 12 | — | 0.06 | 11 | 454 | 1.02 | 0.67 | Example |
| 13 | 450 | 0.04 | 12 | 427 | 0.74 | 0.88 | Example |
| 14 | — | 0.05 | 15 | 497 | 0.19 | 0.27 | Comparative Example |
| 15 | — | 0.03 | 18 | 508 | 0.27 | 0.39 | Comparative Example |
| 16 | — | 0.07 | 16 | 501 | 0.22 | 0.81 | Comparative Example |
| 17 | — | 0.01 | 12 | 356 | 0.12 | 0.72 | Comparative Example |
| 18 | — | 0.06 | 18 | 442 | 0.15 | 0.11 | Comparative Example |
| 19 | — | 0.05 | 17 | 436 | 0.24 | 0.67 | Comparative Example |
| 20 | — | 0.04 | 13 | 470 | 0.23 | 0.68 | Comparative Example |

| | | | Producing Conditions | | | | | | | |
|---|---|---|---|---|---|---|---|---|---|---|
| | | | | Hot rolling | | | | | | |
| | | | | 1050° C. or higher | | lower than 1050° C. to 950° C. or higher | lower than 950° C. | | Cooling | |
| No. | Steel sample ID | Plate thickness (mm) | Heating Heating temperature (° C.) | Cumulative rolling reduction (%) | Average rolling reduction per pass (%) | Cumulative rolling reduction (%) | Cumulative rolling reduction (%) | Average rolling reduction per pass (%) | Average cooling rate *1 (° C./sec) | Stop cooling temperature (° C.) |
| 21 | W | 62 | 1100 | 35 | 11 | 40 | 60 | 8 | 6 | 141 |
| 22 | X | 27 | 1120 | 65 | 15 | 45 | 65 | 16 | 20 | 465 |
| 23 | Y | 69 | 1170 | 30 | 13 | 30 | 65 | 9 | 4 | 577 |
| 24 | Z | 51 | 1080 | 35 | 12 | 35 | 70 | 16 | 10 | 325 |
| 25 | AA | 46 | 1050 | 30 | 13 | 45 | 70 | 10 | 13 | 246 |
| 26 | AB | 51 | 1160 | 25 | 15 | 40 | 65 | 14 | 15 | 54 |
| 27 | AC | 34 | 1080 | 20 | 11 | 35 | 70 | 12 | 21 | 477 |
| 28 | B | 85 | 1070 | 0 | 0 | 15 | 75 | 10 | 5 | 369 |
| 29 | D | 51 | 1080 | 15 | 12 | 50 | 70 | 15 | 15 | 375 |
| 30 | E | 84 | 1150 | 30 | 15 | 40 | 60 | 13 | 0.1 | 481 |
| 31 | J | 98 | 1100 | 50 | 14 | 30 | 30 | 4 | 3 | 378 |
| 32 | K | 47 | 1100 | 35 | 13 | 10 | 80 | 9 | 20 | 558 |
| 33 | L | 27 | 1170 | 55 | 18 | 40 | 75 | 12 | 46 | 256 |
| 34 | N | 73 | 1150 | 30 | 3 | 35 | 60 | 10 | 7 | 237 |
| 35 | M | 60 | 1270 | 25 | 16 | 30 | 65 | 11 | 6 | 569 |
| 36 | AD | 55 | 1100 | 35 | 13 | 30 | 60 | 9 | 9 | 337 |
| 37 | F | 60 | 1140 | 20 | 11 | 30 | 65 | 8 | 12 | 116 |

TABLE 2-continued

| | | Measurement Results | | | | | |
|---|---|---|---|---|---|---|---|
| | | Steel plate (base metal) | | | Multilayer fill weld joint | | |
| No. | Producing Conditions Tempering Tempering temperature (° C.) | Number density of porosities *2 (numbers/mm$^2$) | Average effective grain size at a mid-thickness part (μm) | YS at a position of one quarter in height of plate thickness (MPa) | δ of CGHAZ at −60° C. (mm) | δ of a SC/ICHAZ boundary at −60° C. (mm) | Classification |
| 21 | 500 | 0.03 | 14 | 354 | 0.15 | 0.38 | Comparative Example |
| 22 | — | 0.03 | 13 | 496 | 0.26 | 0.55 | Comparative Example |
| 23 | — | 0.07 | 17 | 486 | 0.14 | 0.26 | Comparative Example |
| 24 | — | 0.02 | 19 | 587 | 0.28 | 0.22 | Comparative Example |
| 25 | — | 0.03 | 17 | 384 | 0.18 | 0.09 | Comparative Example |
| 26 | 450 | 0.08 | 15 | 427 | 0.24 | 0.17 | Comparative Example |
| 27 | — | 0.04 | 10 | 515 | 0.16 | 0.12 | Comparative Example |
| 28 | — | 1.23 | 26 | 392 | 0.61 | 0.21 | Comparative Example |
| 29 | 500 | 0.81 | 14 | 488 | 0.42 | 0.12 | Comparative Example |
| 30 | — | 0.03 | 28 | 403 | 0.77 | 0.25 | Comparative Example |
| 31 | — | 0.08 | 34 | 470 | 0.66 | 0.16 | Comparative Example |
| 32 | — | 0.05 | 24 | 425 | 0.42 | 0.18 | Comparative Example |
| 33 | 850 | 0.06 | 15 | 501 | 0.37 | 0.24 | Comparative Example |
| 34 | — | 0.40 | 11 | 472 | 0.79 | 0.23 | Comparative Example |
| 35 | — | 0.03 | 33 | 513 | 0.24 | 0.13 | Comparative Example |
| 36 | — | 0.06 | 58 | 497 | 0.04 | 0.02 | Comparative Example |
| 37 | 310 | 0.03 | 19 | 458 | 0.64 | 0.52 | Example |

*1 An average cooling rate while a mid-thickness part has a temperature from 700° C. to 550° C.

*2 The number of porosities per mm$^2$, the porosities having an equivalent circular diameter of 200 μm or more

The invention claimed is:

1. A method of producing a steel plate, comprising:

heating a slab to 1050° C. or higher and 1200° C. or lower, the slab having a chemical composition containing, in mass %, C: 0.01% to 0.07%, Si: 0.5% or less, Mn: 1.0% to 2.0%, P: 0.01% or less, S: 0.0005% to 0.0050%, Al: 0.030% or less, Ni: 0.5% to 2.0%, Ti: 0.005% to 0.030%, N: 0.0015% to 0.0065%, O: 0.0010% to 0.0050%, and Ca: 0.0005% to 0.0060%, with a balance being Fe and inevitable impurities; and having Ceq of 0.45% or less, where Ceq is defined by the following Formula (1):

$$Ceq\ (\%)=[C]+[Mn]/6+([Cu]+[Ni])/15+([Cr]+[Mo]+[V])/5 \quad (1);\ \text{and}$$

having Pcm of 0.22% or less, where Pcm is defined by the following Formula (2):

$$Pcm\ (\%)=[C]+[Si]/30+([Mn]+[Cu]+[Cr])/20+[Ni]/60+[Mo]/15+[V]/10+5[B] \quad (2),$$

where the brackets in Formula (1) and Formula (2) indicate a content by mass % of an element enclosed in the brackets and have a value of 0 if such an element is not contained;

hot rolling the heated slab to obtain a hot-rolled steel plate;

cooling the hot-rolled steel plate to a stop cooling temperature of 600° C. or lower under a condition of at an average cooling rate of 3° C./sec to 50° C./sec while a mid-thickness part of the hot-rolled steel plate has a temperature from 700° C. to 550° C., wherein the hot rolling comprises:

(1) rolling with an average rolling reduction of 10% or more per pass and a cumulative rolling reduction of 20% or more when the temperature at a mid-thickness part of the heated slab is 1050° C. or higher to obtain a heated plate;

(2) rolling with a cumulative rolling reduction of 30% or more when the temperature at the mid-thickness part of the heated plate is lower than 1050° C. and 950° C. or higher; and (3) rolling with an average rolling reduction of 8% or more per pass and a cumulative rolling reduction of 60% or more when the temperature at the mid-thickness part of the heated plate is lower than 950° C.

2. The method of producing the steel plate according to claim 1, wherein a tempering treatment is performed at a temperature of 700° C. or lower after the cooling.

3. A method of producing a steel plate, comprising:

heating a slab to 1050° C. or higher and 1200° C. or lower, the slab having a chemical composition containing, in mass %

C: 0.01% to 0.07%,

Si: 0.5% or less,

Mn: 1.0% to 2.0%,

P: 0.01% or less,

S: 0.0005% to 0.0050%,

Al: 0.030% or less,

Ni: 0.5% to 2.0%,

Ti: 0.005% to 0.030%,

N: 0.0015% to 0.0065%,

O: 0.0010% to 0.0050%,

Ca: 0.0005% to 0.0060%, and at least one element selected from the group consisting of Cu: 0.05% to 2.0%, Cr: 0.05% to 0.30%, Mo: 0.05% to 0.30%, Nb: 0.005% to 0.035%,
V: 0.01% to 0.10%,
W: 0.01% to 0.50%,
B: 0.0005% to 0.0020%,
REM: 0.0020% to 0.0200%, and
Mg: 0.0002% to 0.0060%,
with a balance being Fe and inevitable impurities; and
having Ceq of 0.45% or less, where Ceq is defined by the following Formula (1):

$$Ceq\ (\%)=[C]+[Mn]/6+([Cu]+[Ni])/15+([Cr]+[Mo]+[V])/5 \quad (1);\ \text{and}$$

having Pcm of 0.22% or less, where Pcm is defined by the following Formula (2):

$$Pcm\ (\%)=[C]+[Si]/30+([Mn]+[Cu]+[Cr])/20+[Ni]/60+[Mo]/15+[V]/10+5[B] \quad (2),$$

where the brackets in Formula (1) and Formula (2) indicate a content by mass % of an element enclosed in the brackets and have a value of 0 if such an element is not contained;

hot rolling the heated slab to obtain a hot-rolled steel plate;

cooling the hot-rolled steel plate to a stop cooling temperature of 600° C. or lower under a condition of at an average cooling rate of 3° C./sec to 50° C./sec while a mid-thickness part of the hot-rolled steel plate has a temperature from 700° C. to 550° C., wherein the hot rolling comprises:

(1) rolling with an average rolling reduction of 10% or more per pass and a cumulative rolling reduction of 20% or more when the temperature at a mid-thickness part of the heated slab is 1050° C. or higher to obtain a heated plate;

(2) rolling with a cumulative rolling reduction of 30% or more when the temperature at the mid-thickness part of the heated plate is lower than 1050° C. and 950° C. or higher; and (3) rolling with an average rolling reduction of 8% or more per pass and a cumulative rolling reduction of 60% or more when the temperature at the mid-thickness part of the heated plate is lower than 950° C.

4. The method of producing the steel plate according to claim 3, wherein a tempering treatment is performed at a temperature of 700° C. or lower after the cooling.

* * * * *